US005435352A

United States Patent [19]

Yamamoto et al.

[11] Patent Number: 5,435,352

[45] Date of Patent: Jul. 25, 1995

[54] WEAVING METHOD FOR IN-PLANE MULTIAXIAL THICK WOVEN FABRICS

[75] Inventors: Tetsuya Yamamoto; Shigeru Nishiyama, both of Nagoya, Japan

[73] Assignee: Mitsubishi Jukogyo Kabushiki Kaisha, Tokyo, Japan

[21] Appl. No.: 71,254

[22] Filed: Jun. 4, 1993

[30] Foreign Application Priority Data

Jun. 5, 1992 [JP] Japan ..... 4-169854

[51] Int. Cl.[6] ..... D03D 11/00; D03D 41/00

[52] U.S. Cl. ..... 139/11; 139/DIG. 1; 139/55.1; 139/84; 139/190; 139/48

[58] Field of Search ..... 139/384 R, 11, 408, 139/DIG. 1, 55.1, 84, 190, 48

[56] References Cited

U.S. PATENT DOCUMENTS

| | | | |
|---|---|---|---|
| 4,019,540 | 4/1977 | Holman et al. | 139/20 |
| 4,046,173 | 9/1977 | Kulczycki | 139/48 |
| 4,512,373 | 4/1985 | Trost | 139/11 |
| 5,024,874 | 6/1991 | Yasui et al. | 428/257 |
| 5,085,252 | 2/1992 | Mohamed et al. | 139/DIG. 1 X |
| 5,137,058 | 8/1992 | Anahara et al. | 139/DIG. 1 X |
| 5,224,519 | 7/1993 | Farley | 139/DIG. 1 X |

FOREIGN PATENT DOCUMENTS

| | | |
|---|---|---|
| 0346030 | 12/1989 | European Pat. Off. . |
| 0474090 | 3/1992 | European Pat. Off. . |
| 2319727 | 2/1977 | France . |
| 2-6649 | 1/1990 | Japan . |
| 2-13060 | 4/1990 | Japan . |

OTHER PUBLICATIONS

Design Methodology of 3-D Woven Structures, Oct. 21, 1991, Morales, Composite Textile Tech Group, ICI Fiberite, Greenville Tex.

American Scientist, vol. 78, pp. 530-541, Three-dimensional Textiles, Mohamed.

SAMPE Journal, vol. 29, No. 1, Jan./Feb. 1993, pp. 7—12, Horsting et al.

*Primary Examiner*—Andrew M. Falik

*Attorney, Agent, or Firm*—Jacobson, Price, Holman & Stern

[57] ABSTRACT

A method of manufacturing multiaxial thick woven fabrics (8) using healds (3) through which warps are passed, a shuttle (5) reciprocating so as to insert wefts (6) in a warp shedding portion (19) formed by the healds, a reed (9), and a woven fabric removing device (10). A large number of healds are provided in parallel in the direction of woven fabric removal. The shedding portion is formed by passing a plurality of warps so that predetermined thickness and width of the woven fabric are produced through the healds and by widely reciprocating the healds in the width direction, moving the shedding position sequentially from one side to the other side, inserting a weft sequentially in the shedding portion and arranging it by shifting the weft position in the width direction. A texture of the first row of predetermined width and thickness is formed by fixing warps. Multiaxial thick woven fabric of a continuous length is produced by performing shedding, weft insertion, and beating sequentially, so that when the shedding position shifts from the travel passage of the shuttle, the woven fabric removing device is moved vertically by an up and down motion rack in cooperation with the travel passage of the shuttle.

2 Claims, 15 Drawing Sheets

FIG. 14

| STP | HEALD (THREAD) No. | | | | | | | | | | | | | | |
|---|---|---|---|---|---|---|---|---|---|---|---|---|---|---|---|
| | 0 | a | b | c | d | e | f | g | h | i | j | k | l | m | n |
| 1 | • | • | x | x | x | x | x | x | x | x | x | x | x | x | x |
| 2 | • | • | • | • | x | x | x | x | x | x | x | • | x | x | x |
| 3 | • | • | • | • | • | • | x | x | x | x | x | • | • | x | x |
| 4 | • | • | • | • | • | • | • | • | x | x | x | • | • | • | x |
| 5 | • | • | • | • | • | • | • | • | • | • | x | • | • | • | • |
| 6 | x | • | • | • | • | • | • | • | x | • | • | • | • | • | • |
| 7 | x | • | • | • | • | • | x | • | x | • | x | • | • | • | x |
| 8 | x | • | • | • | x | • | x | • | x | x | x | • | • | x | x |
| 9 | x | • | x | • | x | • | x | x | x | x | x | • | x | x | x |
| 10 | x | x | x | • | x | x | x | x | x | x | x | x | x | x | x |
| 11 | • | x | x | x | x | • | x | x | x | x | x | x | x | x | x |
| 12 | • | x | x | • | x | • | x | • | x | x | x | • | x | x | x |
| 13 | • | • | x | • | x | • | x | • | x | • | x | • | • | x | x |
| 14 | • | • | • | • | x | • | x | • | x | • | • | • | • | • | x |
| 15 | • | • | • | • | • | • | x | • | • | • | • | • | • | • | • |
| 16 | x | • | • | • | x | • | • | • | • | • | • | • | • | • | • |
| 17 | x | • | x | • | x | • | x | • | • | • | • | • | • | • | x |
| 18 | x | x | x | • | x | • | x | • | x | • | • | • | • | x | x |
| 19 | x | x | x | x | x | • | x | • | x | • | x | • | x | x | x |
| 20 | x | x | x | x | x | x | x | • | x | x | x | x | x | x | x |
| 21 | • | x | x | x | x | x | x | x | x | • | x | x | x | x | x |
| 22 | • | x | x | x | x | x | x | • | x | • | • | • | x | x | x |
| 23 | • | x | x | x | x | • | x | • | • | • | • | • | • | x | x |
| 24 | • | x | x | • | x | • | • | • | • | • | • | • | • | • | x |
| 25 | • | • | x | • | • | • | • | • | • | • | • | • | • | • | • |
| 26 | x | x | • | • | • | • | • | • | • | • | • | • | • | • | • |
| 27 | x | x | x | x | • | • | • | • | • | • | • | • | • | • | x |
| 28 | x | x | x | x | x | x | • | • | • | • | • | • | • | x | x |
| 29 | x | x | x | x | x | x | x | x | • | • | • | • | x | x | x |
| 30 | x | x | x | x | x | x | x | x | x | x | • | x | x | x | x |
| 31 | • | x | x | x | x | x | x | x | • | x | x | x | x | x | x |
| 32 | • | x | x | x | x | x | • | x | • | x | • | • | x | x | x |
| 33 | • | x | x | x | • | x | • | x | • | • | • | • | • | x | x |
| 34 | • | x | • | x | • | x | • | • | • | • | • | • | • | • | x |
| 35 | • | • | • | x | • | • | • | • | • | • | • | • | • | • | • |
| 36 | x | • | • | • | • | x | • | • | • | • | • | • | • | • | • |
| 37 | x | • | • | x | • | x | • | x | • | • | • | • | • | • | x |
| 38 | x | x | • | x | • | x | • | x | • | x | • | • | • | x | x |
| 39 | x | x | x | x | • | x | • | x | • | x | x | • | x | x | x |
| 40 | x | x | x | x | x | x | • | x | x | x | x | x | x | x | x |
| 41 | • | x | x | x | • | x | x | x | x | x | x | x | x | x | x |
| 42 | • | x | • | x | • | x | • | x | x | x | x | • | x | x | x |
| 43 | • | • | • | x | • | x | • | x | • | x | x | • | • | x | x |
| 44 | • | • | • | • | • | x | • | x | • | x | • | • | • | • | x |
| 45 | • | • | • | • | • | • | • | x | • | • | • | • | • | • | • |
| 46 | x | • | • | • | • | • | • | • | • | x | • | • | • | • | • |
| 47 | x | • | • | • | • | • | • | x | • | x | x | • | • | • | x |
| 48 | x | • | • | • | • | x | • | x | x | x | x | • | • | x | x |
| 49 | x | • | • | x | • | x | x | x | x | x | x | • | x | x | x |
| 50 | x | x | • | x | x | x | x | x | x | x | x | x | x | x | x |

• HEALD UP x HEALD DOWN

TIME CHART

* INCLUDING VERTICAL MOVING MECHANISM

WEAVING METHOD FOR IN-PLANE MULTIAXIAL THICK WOVEN FABRICS

BACKGROUND OF THE INVENTION

The present invention relates to a weaving method for in-plane multiaxial thick woven fabrics which are effectively used for interior and exterior materials of aircraft and the like.

Conventionally, glass fiber woven fabrics which are impregnated with thermosetting resin, reinforced resin parts which are formed by laminating carbon fiber woven fabrics in multiple layers and by heating and curing, and composite material parts have been used for interior and exterior materials of aircraft and in other various industrial fields because they are light in weight and have high mechanical strength. In the case where this material is used for the external surface of aircraft shell or the like, there is a problem in that separation occurs when a stone or the like strikes the external surface when the aircraft runs on the ground.

To solve this problem, a three-dimensional woven fabric for reinforcing a structure, in which layers of woven fabric are integrally connected by using knotting thread, has been disclosed in Japanese Patent Publication No. 13060/1990.

The three-dimensional woven fabric disclosed in Japanese Patent Publication No. 13060/1990 will be described with reference to FIGS. 17 and 18. In these figures, reference numerals 50, 50*a* to 50*c* denote warps, 51, 51*a* to 51*d* denote wefts, and 52*a* and 52*b* denote knotting threads. This three-dimensional woven fabric is woven with a weaving machine. As shown in FIG. 17, wefts 51*a* to 51*d* are laminated in parallel, warps 50*a* to 50*c* are laminated perpendicular to the wefts, and knotting threads 52*a* and 52*b* fix internal warps 50*a* to 50*c* and wefts 51*b* and 51*c* by turning at the outside wefts 51*a* and 51*d*.

As described above, conventional composite material parts in which woven fabric impregnated with thermosetting resin is laminated and heated for formation has a disadvantage that the laminated woven fabric is separated by a shock due to collision from the outside.

With the three-dimensional woven fabric shown in FIGS. 17 and 18, in which laminated warp layer and weft layer are connected by knotting threads 52*a* and 52*b*, separation occurring in composite material parts, in which woven fabric impregnated with thermosetting resin is laminated and heated for curing, does not occur. In this woven fabric, however, fibers cannot be arranged in a multiaxial mode in a plane, there being a problem in that fiber arrangement for lightweight and optimized mechanical strength cannot be set.

To solve the above problem, Japanese Patent Application No. 157513/1988 discloses a method in which triaxial or quadaxial woven fabric with simple structure can be formed by a weft insertion device and a beating-up device by crossing a diagonal warp supplied from a creel for diagonal warp and a diagonal warp of opposite direction alternately in the reverse inclined direction and then by appropriately shedding after transforming to substantially right angles. However, this method can weave only thin in-plane multiaxial woven fabrics. In this case, as described in the prior art, a problem of separation is posed because a laminating operation is required. Also, there is a problem in that the prior art cannot obtain in-plane multiaxial thick woven fabrics.

OBJECT AND SUMMARY OF THE INVENTION

Accordingly, an object of the present invention is to provide a weaving method in which fibers are arranged on an internal plane in a multiaxial mode by using warps and wefts, and a three-dimensional woven fabric with a thickness in the plate thickness direction can be manufactured.

To achieve the above object, the present invention provides a method of manufacturing in-plane multiaxial thick woven fabrics using a weaving machine comprising healds through which warps are passed, a shuttle reciprocating so as to insert wefts in a warp shedding portion formed by the heald, a reed, and a woven fabric removing device, comprising the steps of providing a large number of healds in parallel in the direction of woven fabric removal; forming a shedding portion by passing warps of the number such that predetermined thickness and width of woven fabric are formed through the healds and by widely reciprocating the healds in the width direction; moving the shedding position sequentially from one side to the other side in the woven fabric width direction; inserting a weft sequentially in the shedding portion and arranging it by shifting the weft position in the width direction; forming a texture of the first row of predetermined width and thickness by fixing warps; and manufacturing an in-plane multiaxial thick woven fabric of a continuous length by performing shedding, weft insertion, and beating sequentially, wherein when the shedding position shifts from the travel passage of the shuttle, the woven fabric removing device is moved vertically so as to agree with the travel passage of the shuttle.

Also, the present invention provides a method of manufacturing in-plane multiaxial thick woven fabrics wherein the width between selvedges formed by the warp at each end in the direction of the width of woven fabric to be manufactured is kept constant, by which the shrinkage of woven fabric in the width direction due to the tension of warp is prevented.

Further, a weaving machine for manufacturing in-plane multiaxial thick woven fabrics in accordance with this method having healds through which warps are passed, a shuttle reciprocating so as to insert wefts in a warp shedding portion formed by said heald, a reed, and a woven fabric removing device, wherein warps of the number such that predetermined thickness and width of woven fabric are formed are passed, and the weaving machine is provided with a reciprocating mechanism for widely reciprocating the heald in the woven fabric width direction, a mechanism for reciprocating the woven fabric removing device so as to agree with the travel passage of the shuttle, and a fixing mechanism for fixing the width of a selvedge in a constant manner by engaging the selvedge formed by warp at each end in the woven fabric width direction.

The operation of the present invention is as follows: The warps pulled out from the group of bobbins 2 are allowed to pass through the respective healds and further pass through the reed, and then fixed to the woven fabric removing portion. At this time, an up-and-down motion rack is lowered down to a position where the shed centerline of the heald agrees with the shedding portion of woven fabric. The shedding procedure is performed as shown in FIG. 14. In addition to the shedding procedure, the operation sequence of each part is inputted in a computer beforehand.

In the operation of the present invention, the operation is basically performed in the order of shedding, weft insertion, beating, winding, and vertical movement. Only when the warp forming a selvedge appears, the operation is performed in the order of shedding, weft insertion, selvedge holding, beating, winding, and vertical movement.

The winding amount of woven fabric for each step is set so that the woven fabric is advanced by division in such a manner that a desired pitch in the weft length direction is obtained when the weft advances from the uppermost (lowermost) weft position to the lowermost (uppermost) weft position, or, as necessary, the woven fabric is advanced by a desired pitch in the weft length direction at a time when the weft advances from the uppermost (lowermost) weft position to the lowermost (uppermost) weft position.

In this case, the weaving machine is operated in the order of shedding, weft insertion, beating, and vertical movement. Only when the warp forming a selvedge appears, the operation is performed in the order of shedding, weft insertion, selvedge holding, beating, winding (by a pitch in the weft length direction. When the warp forming a selvedge appears two times continuously, the latter need not be wound.), and vertical movement. The amount of vertical movement is allowed to coincide with a desired vertical pitch, or determined empirically on the basis of the desired vertical pitch.

According to the present invention described above, in-plane multiaxial thick three-dimensional woven fabrics can be manufactured automatically with high efficiency by using a weaving machine. Since a selvedge formed by a warp loop is formed at each end in the width direction, there is no disadvantage that the warp comes off, or frays at each end. Also, since many healds are used and moved for a large width, the weft can be arranged at intervals vertically in the first row, thick woven fabrics in which warp is fixed by weft can be manufactured, and three-dimensional woven fabrics in which no cut end of warp and weft is present in the width direction can be manufactured.

BRIEF DESCRIPTION OF THE DRAWINGS

The invention will now be described in detail with reference to the accompanying drawings wherein:

FIG. 13(*i*) is an enlarged cross-sectional view of the fabric woven by the sequence of operations of FIGS. 13(*a*)–13(*h*);

FIG. 14 is a chart showing the raising and lowering of heald for each step in relation to the warp in the weaving method of the present invention;

DETAILED DESCRIPTION OF PREFERRED EMBODIMENT

Figure 1:
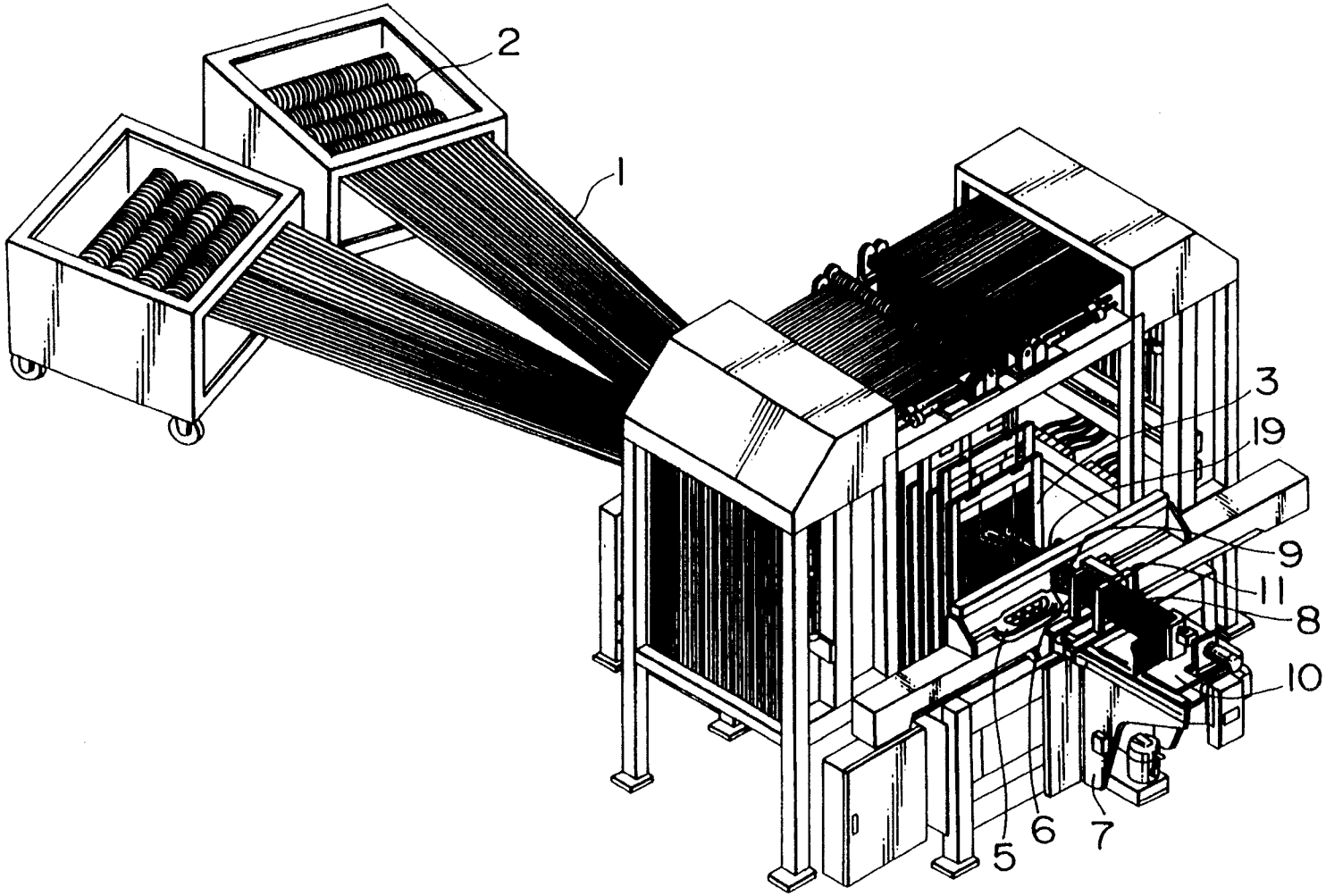
FIG. 1 is a perspective view of a weaving machine for manufacturing in-plane multiaxial thick woven fabrics in accordance with an embodiment of the present invention.

An embodiment of the present invention will be described below with reference to FIGS. 1 through 15.

First, a weaving machine for manufacturing multiaxial thick woven fabrics in accordance with one embodiment of the present invention will be described with reference to FIGS. 1 through 9. Many warps 1 are unwound from bobbins 2 and arranged in a flat plane form, and then are allowed to pass through opening healds 3. The healds 3 are installed in large numbers in parallel in the front and rear direction. Warps 1 of the number such that a predetermined thickness is formed are allowed to pass through the mail of each heald. Each heald moves vertically to form a shed 4, and a weft 6 is allowed to pass through the shed 4 by a shuttle 5. The weft 6 is turned and inserted into the shed 4 of the next warp 1 to form a selvedge at each side in the width direction. The shed 4 of the warp 1 moves vertically in relation to the direction of the width of woven fabric, and an up-and-down motion rack 7 vertically moves the woven fabric 8. Therefore, the weft 6 inserted in each shed 4 is also arranged in the width direction at a predetermined position in the woven fabric between the warps 1 and fixed in that position. Thus, the width dimension of the woven fabric is formed. A reed 9 beats up the weft 6 to the cloth fell after the weft 6 is inserted into the shed 4 by the shuttle 5, thereby the crossing of warp and weft being completed.

Figure 5:
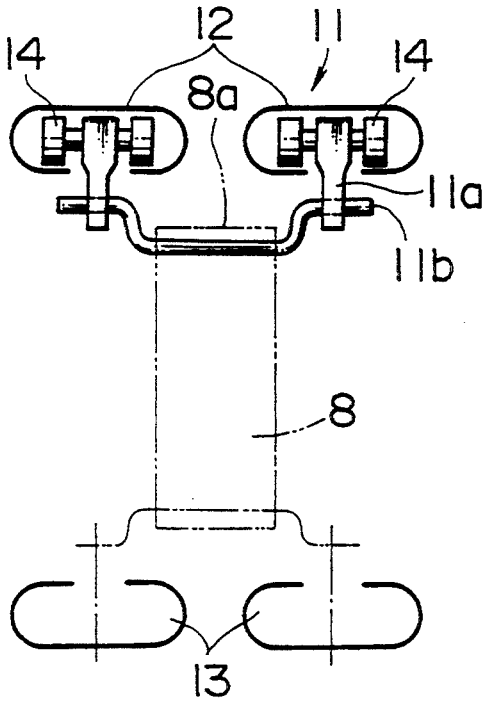
FIG. 5 is a front view of a selvedge holding member mounted on the rail of FIG. 4.
Figure 6:
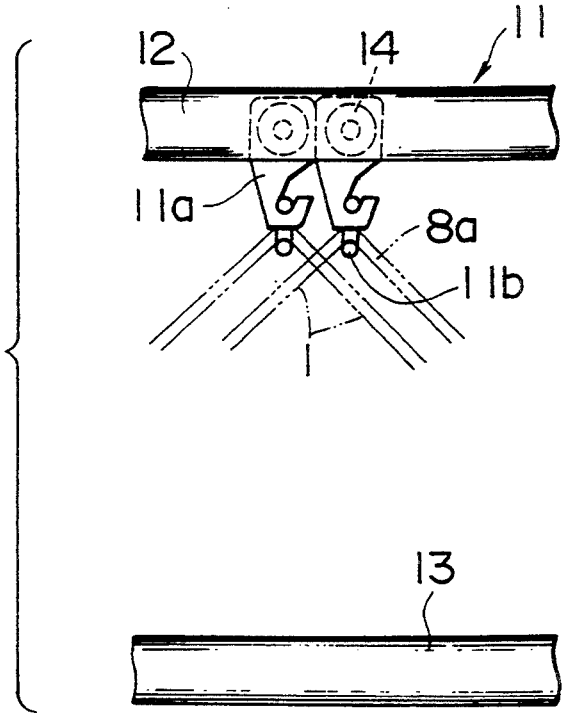
FIG. 6 is a right side view of FIG. 5.

Reference numeral 10 denotes a woven fabric removing portion which pulls out the woven fabric manufactured by vertical movement by means of the up-and-down motion rack, and 11 denotes a weave end retaining mechanism hereinafter referred to as a selvedge holding mechanism for holding in position a selvedge 8*a* of warp 1 formed at each end in the width direction of the woven fabric 8. This selvedge holding mechanism has a woven fabric holding bar 11*b* which engages with a hook 11*a* (FIG. 5). The bar 11*b* hooks the selvedge 8*a* to prevent the shrinkage of the width of woven fabric 8 due to the tension of warp, thereby the width of woven fabric being held constant. The hook 11*a* slides in rails 12, 12, 13, 13 fixed at the upper and lower portions of the selvedge holding mechanism 11 via a roller 14 or the like. When the woven fabric 8 moves from position of the selvedge holding mechanism 11 toward the woven fabric removing portion 10, the hook 11*a* comes off from the rails 12 and 13. Afterward, the woven fabric holding bar 11*b* is removed manually or automatically. The bar 11*b* is installed to the selvedge of woven fabric 8 manually or automatically.

More particularly and with reference to FIGS. 1, 2, 4, 5, and 6 particularly, along with the weaving operation, the hook 11*a* starts to move slowly on the rails 12 and 13 and when it reaches their ends, the rollers 14 can be disengaged from them. The roller 14, hook 11*a* and bar 11*b* disengaged from the rails 12 and 13 may assume a condition wherein they are hung on the selvedge 8*a* of the fabric so that the hook 11*a* is first removed from the bar 11*b* and then the bar 11*b* is removed from the selvedge 8*a*. This removing operation may be carried out manually.

Figure 7:
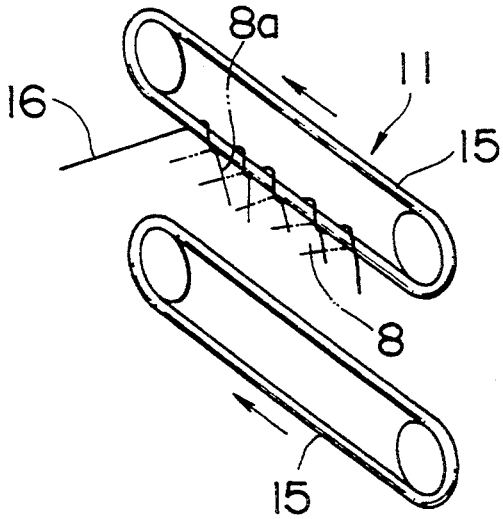
FIG. 7 is a perspective view of a selvedge holding mechanism of an embodiment different from that of FIG. 5.
Figure 8:
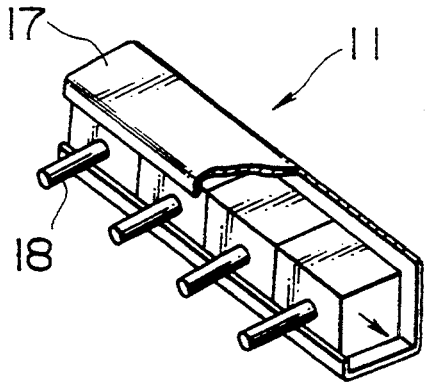
FIG. 8 is a perspective view of a selvedge holding mechanism of a further embodiment different from that of FIG. 7.

The selvedge holding mechanism 11, unlike the embodiment of FIG. 5, may be provided with a wire 16 sequentially wound around an endless wire 15 installed over and under the woven fabric 8 as shown in FIG. 7 so that the wire 16 engages with the selvedge 8*a* of the woven fabric 8 and the wire 15 alternately to keep the width of the woven fabric 8 constant. Further, a device shown in FIG. 8 may be used, in which a block 18 with a bar which is allowed to pass through the selvedge 8*a* of woven fabric is inserted into a rail 17 installed over and under the woven fabric 8.

Figure 9:
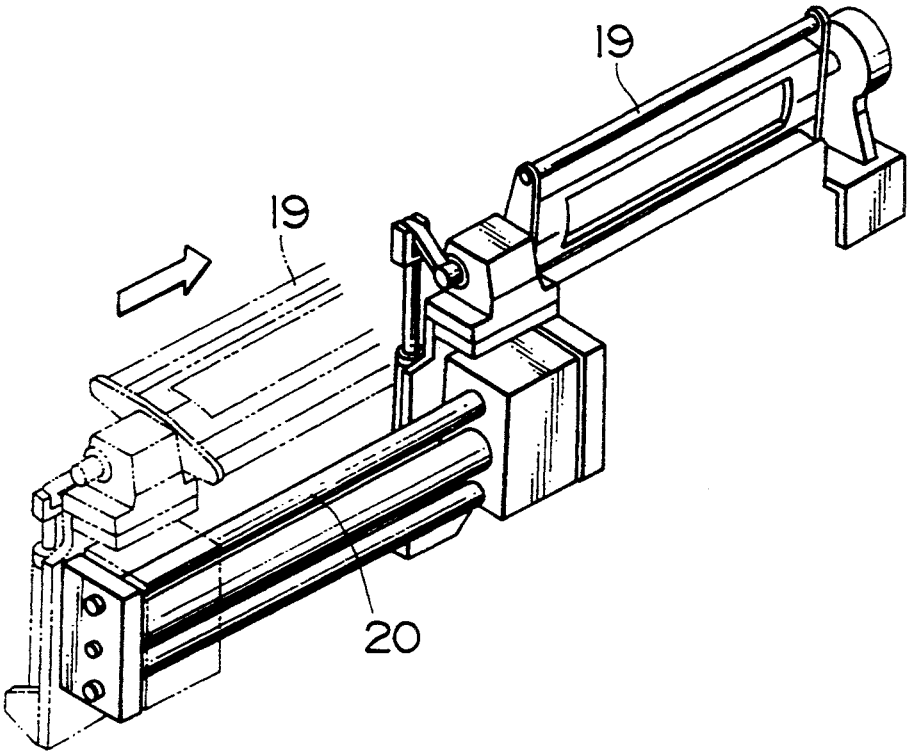
FIG. 9 is a perspective view of one embodiment of an auxiliary shedding device.

An auxiliary shedding device 19 is installed to insert the weft 6 smoothly by increasing the shedding angle because the shedding angle of the warp 1 is decreased as the group of healds increases so that the warp 1 is rubbed when the shuttle 5 moves. FIG. 9 is a detailed view of the auxiliary shedding device 19. The auxiliary shedding device opens by moving into the shed 4 as shown by a solid line, as necessary, from the withdrawal position shown by a two-dot chain line by means of a guide device 20.

The reed 9 is installed over the arm 21 of the beating device, and the arm 21 is constructed so as to move back and forth with its lower end being a fulcrum by the action of a beating air cylinder 22 connected at the middle portion to perform beating. The air cylinder 22 is connected to a frame 23.

Figure 3:
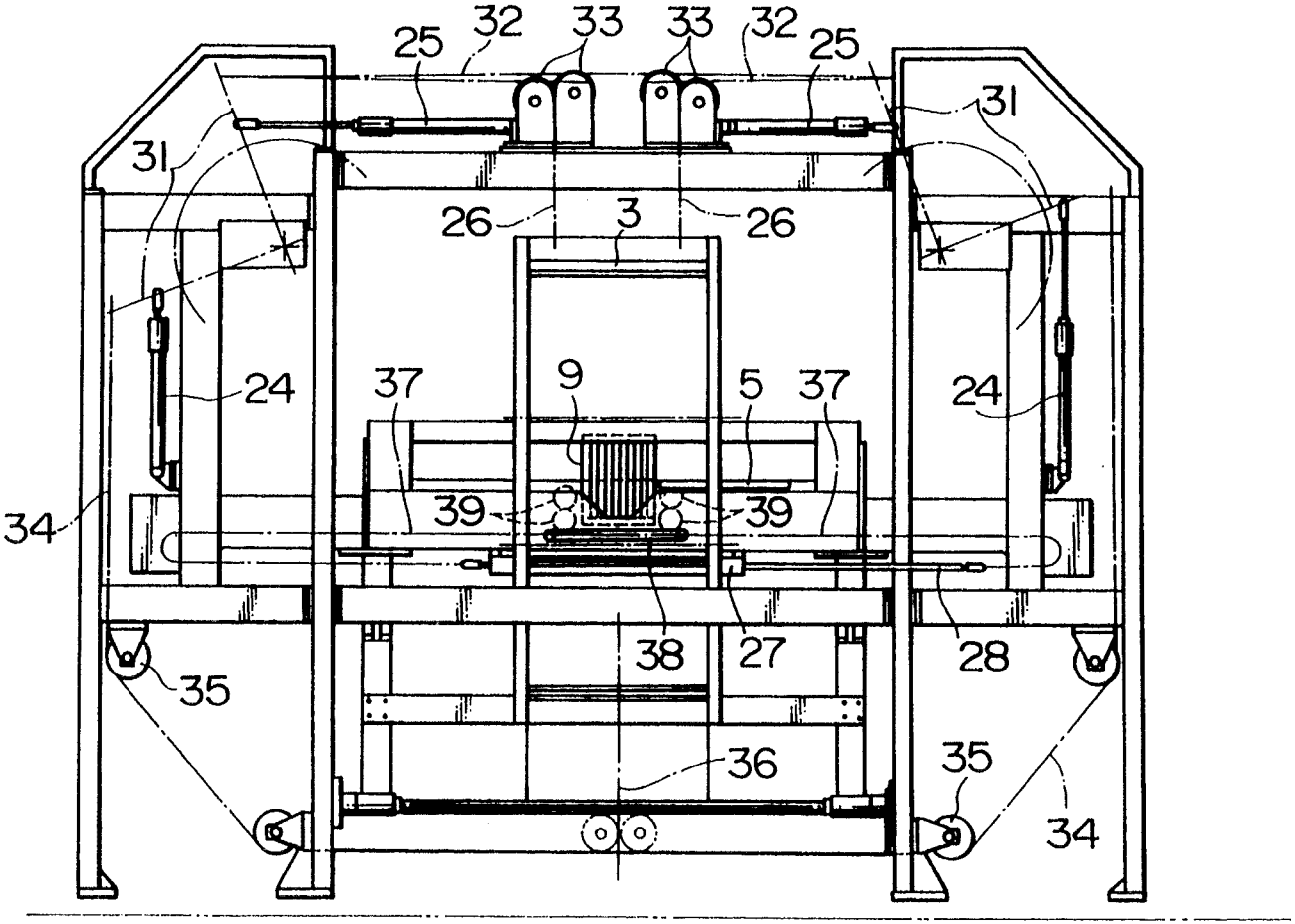
FIG. 3 is an enlarged front view of the main portion of the machine of FIG. 1.
Figure 4:
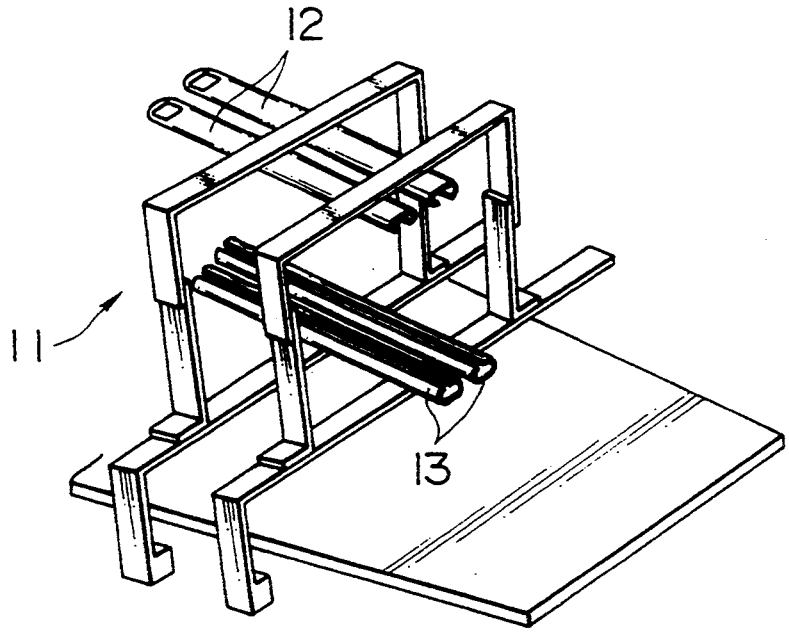
FIG. 4 is an enlarged perspective view of a rail portion in a selvedge holding mechanism of the machine of FIG. 1.

The frame 23 has cylinders 24, 24, 25, 25 for raising/lowering the healds as shown in FIG. 3. The rod end of the air cylinder 24, 24 is connected to one end of a bell crank 31, 31, and the other end of the bell crank 31, 31 is connected to a wire 32, 32. The wire 32, 32 is connected to the heald 3 via a grooved wheel 33, 33 and a wire 26, 26 for driving the heald to raise the heald 3. At the other end of the bell crank 31, the rod end of the cylinder 25, 25 for raising/lowering the heald is connected, and the cylinder 25, 25 is also connected to the wire 26, 26 for driving the heald. At one end of the bell crank 31, 31, a wire 34, 34 is connected to a wire 36 for pulling down the heald 3 via a grooved wheel 35, 35.

An air cylinder 27 for activating the shuttle has rods 28, 28 extending to the right and the left. The rod 28, 28 is connected to a wire 37, 37. The wire 37, 37 is connected to each end of a rack 38, so that when one of the rods 28, 28 stretches, one wire 37 stretches, thereby the rack 38 being moved in one direction. Therefore, the shuttle 5 is constructed so as to run in the shed 4 from one side to the other by the rotation of a pinion 39 engaging with the rack 38. The shuttle 5 also has a rack engaging with the pinion 39 on its lower surface. When the other of the rods 28 stretches, the shuttle runs in the reverse direction.

Figure 2:
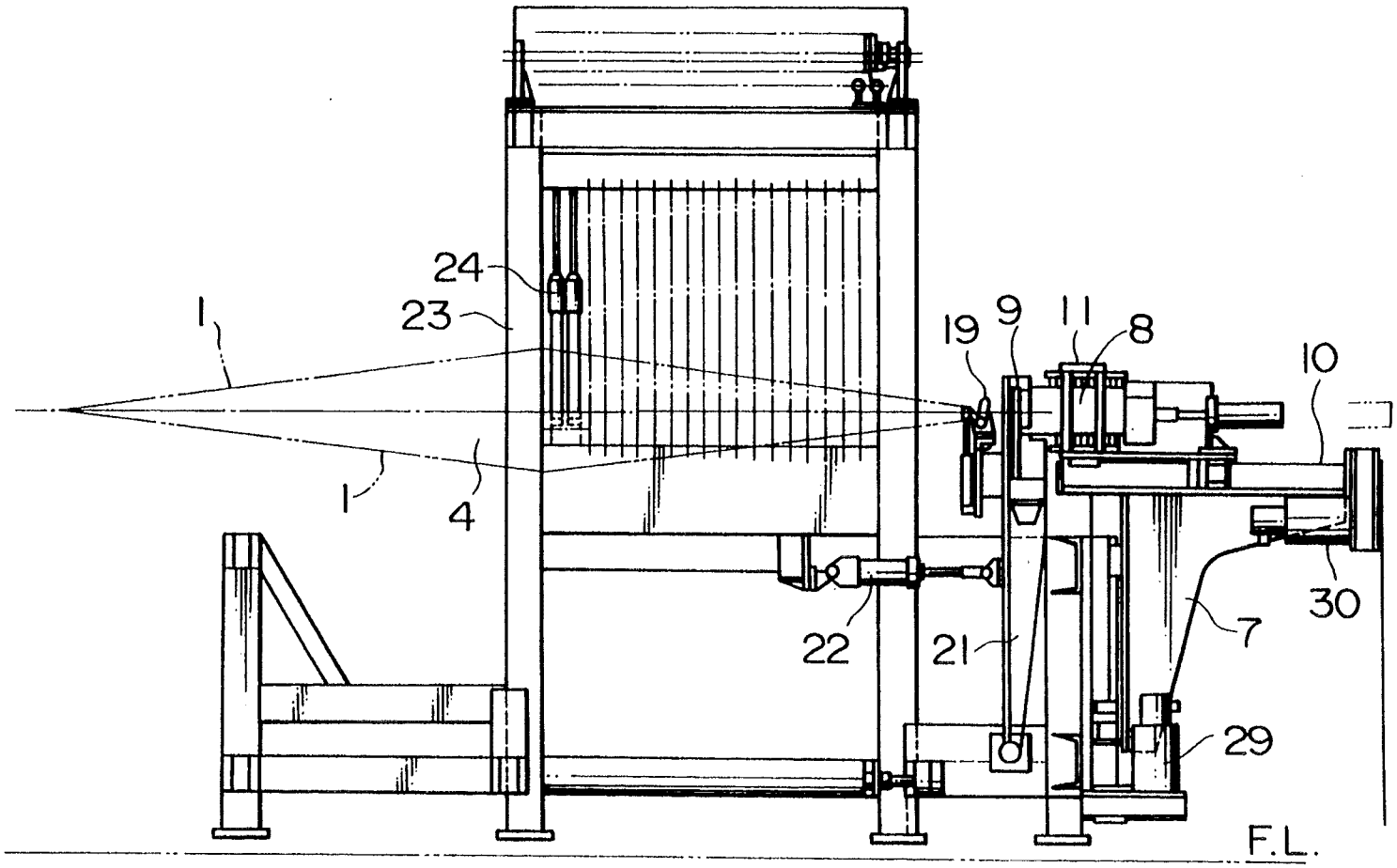
FIG. 2 is an enlarged left side view of the main portion of the weaving machine of FIG. 1.

When the above drive mechanism, the operation by an air cylinder is preferable because the movement of the heald 3, the reed 9, the shuttle 5, and the auxiliary shedding device 19 is constant. For the up-and-down motion rack 7 and the woven fabric removing portion 10, a servomotor is preferably used because the moving amount must be changed depending on the thickness of warp 1 and weft 6 and the structure of woven fabric. Since all controls of aforesaid drive mechanisms are performed by a computer, the drive sequence can be changed and the drive amount for up-and-down motion rack 7 and the woven fabric removing portion 10 can be easily changed. Further, it is preferable that the group of bobbins 2 have a mechanism such that the tension of each warp can be controlled because the feed amount of each warp 1 set up to each heald differs. In FIG. 2, reference numeral 29 denotes a servomotor for raising/lowering the woven fabric, and 30 denotes a servomotor for pulling out the woven fabric. The manner in which the servomotor 30 is utilized as described would be readily apparent to one having ordinary skill in this art and therefore is not shown in detail, since the operation of such a servomotor is conventional in this art. In the above embodiment, the healds 3 are installed in parallel in the front and rear direction and moved vertically to form a shed 4 for the warp 1. However, a construction may be used in which the healds 3 are arranged vertically to run the warps from up to down and the healds are moved back and forth, so that the woven fabric is removed downward.

Next, the operation will be described with reference to FIGS. 10 and 11. The warps 1*a* to 1*q* pulled out from the group of bobbins 2 (not shown) are allowed to pass through the respective healds 3*a* to 3*q* and further pass through the reed 9, and then fixed to the woven fabric removing portion 10. It is preferable that the position of warp generally coincide with the arrangement sequence on the weaving start side as shown by a black circle (weft) in FIG. 12. At this time, the up-and-down motion rack 7 is lowered down to a position where the shed centerline of the heald agrees with the shedding portion of woven fabric (first, the position of black circle). The shedding procedure is performed as shown in FIG. 14. In addition to this shedding procedure, the operation sequence of each part is inputted in a computer beforehand.

With a conventional weaving machine, the operation of each part is performed in the order of shedding, weft insertion, beating, and pulling out. When weaving is performed with the weaving machine of the present invention, the operation is basically performed in the order of shedding, weft insertion, beating, pulling out, and up-and-down movement of rack 7. Only when the warp forming a selvedge appears, the operation is performed in the order of shedding, weft insertion, selvedge holding, beating, winding, and up-and-down movement.

Figure 10:
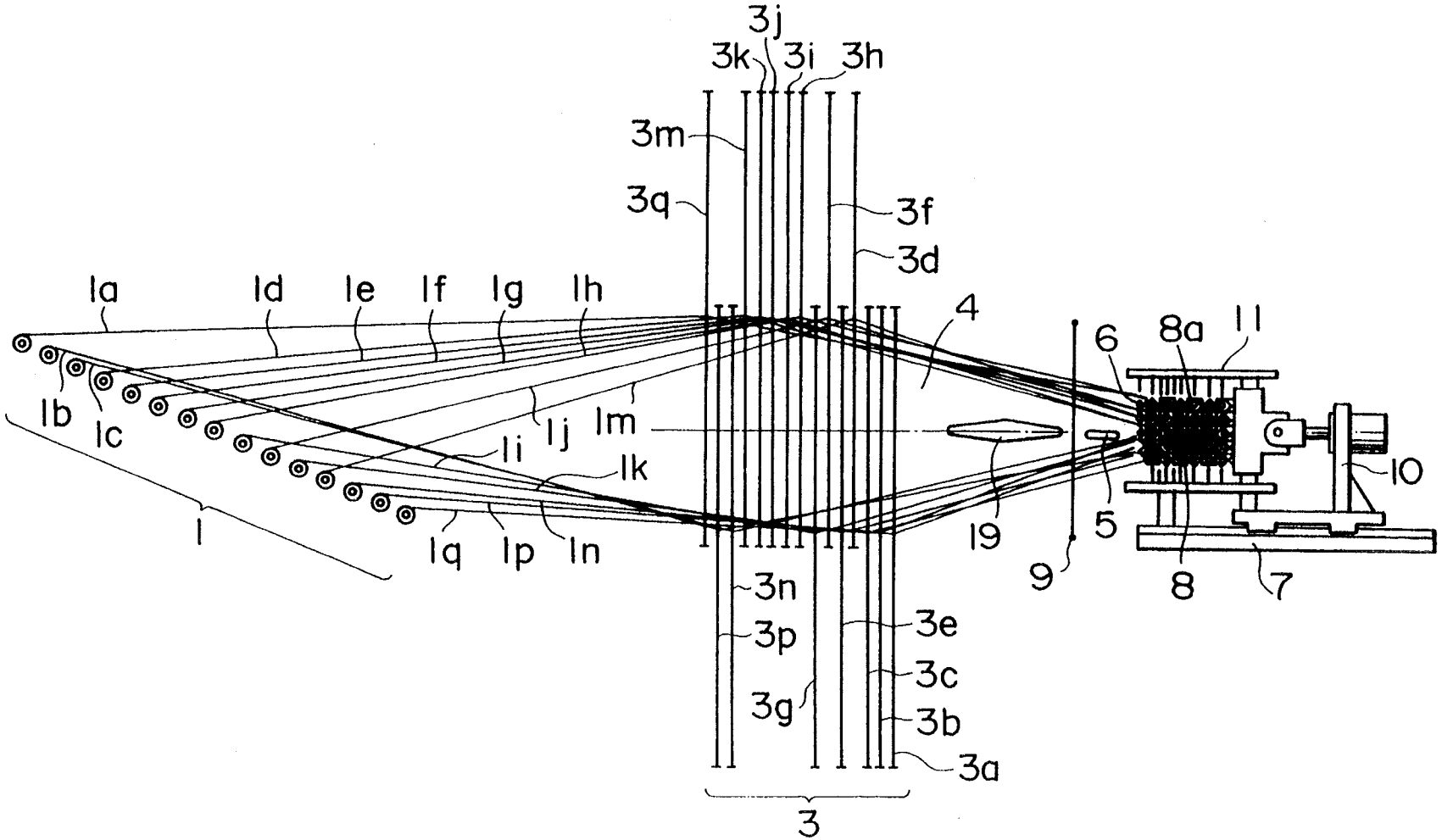
FIG. 10 is a schematic view illustrating one embodiment of the weaving method of the present invention.

FIG. 10 shows the state in which the beating of the 33rd step shown in FIG. 14 has been completed (which differs slightly from the actual warp condition). In this state, the up-and-down motion rack 7 is adjusted so that the shedding portion of woven fabric agrees approximately with the position of central weft.

Figure 11:
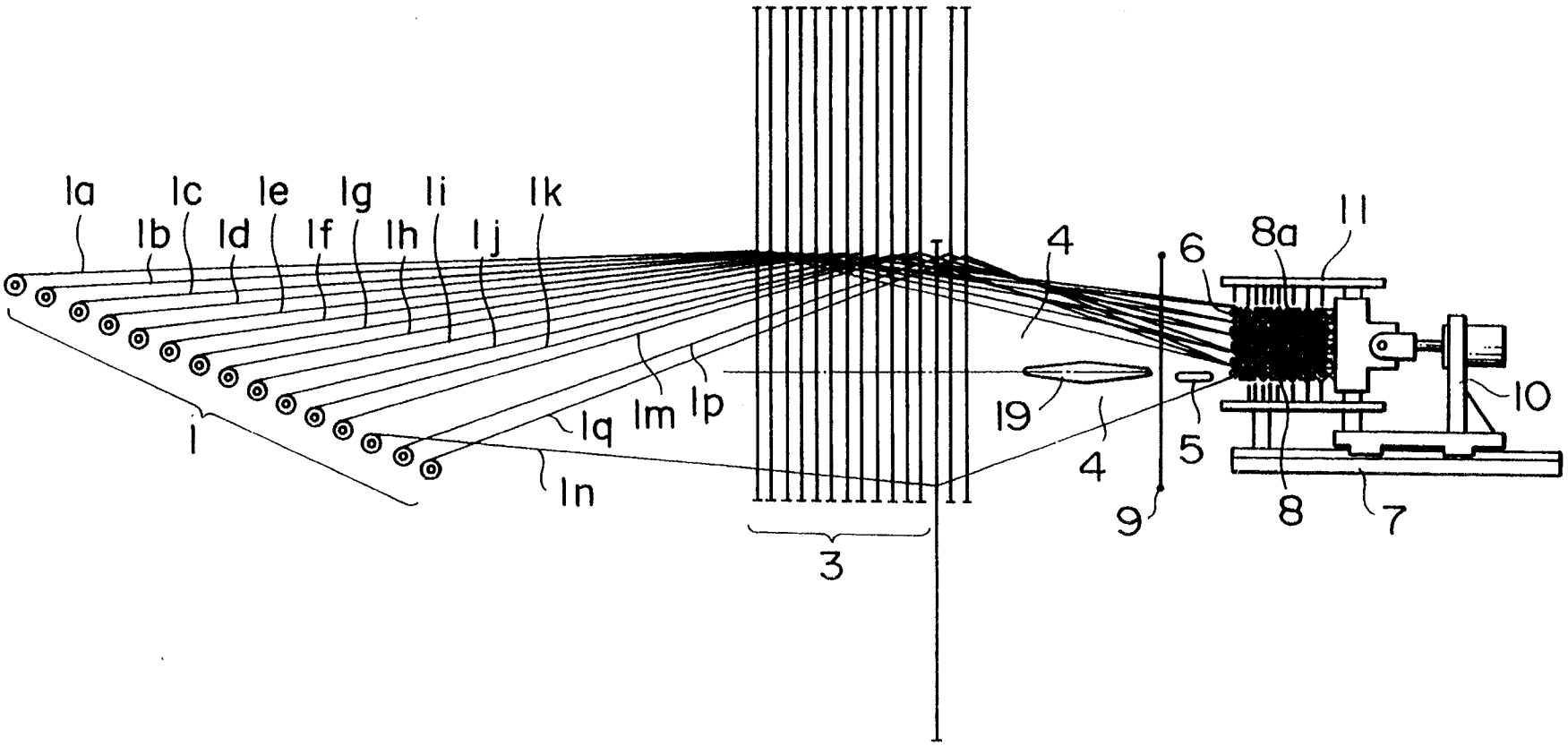
FIG. 11 is a schematic view showing an operating condition different from that of FIG. 10.

FIG. 11 schematically shows the state in which the insertion of weft of the 35th step shown in FIG. 14 has been completed. In this state, the warp in forming a selvedge appears at the lowermost position. Therefore, the holding of the selvedge 8*a* is then performed by the selvedge holding mechanism 11. After beating is performed, winding is carried out to proceed to the 36th step.

Next, a weaving method for the in-plane multiaxial thick woven fabric 8 [FIG. 13(*i*)] will be described with reference to FIGS. 13(*a*) through (*h*). In this embodiment, 12 warps 1A to $1E_3$ and four stages of weft 6 are inserted. In this figure, the warp 1A, moving in a zigzag direction, composes the width direction of the woven fabric, and forms a loop 8*a* at each end. The warps 1B, 1C, 1D, IF, 1G, 1H, 1J, and 1K compose the diagonal direction of the woven fabric, and the warps $1E_1$, $1E_2$, and $1E_3$, compose the lengthwise direction of the woven fabric.

Figures 13A, 13B, 13C, 13D, 13E, 13F, 13G, 13H:
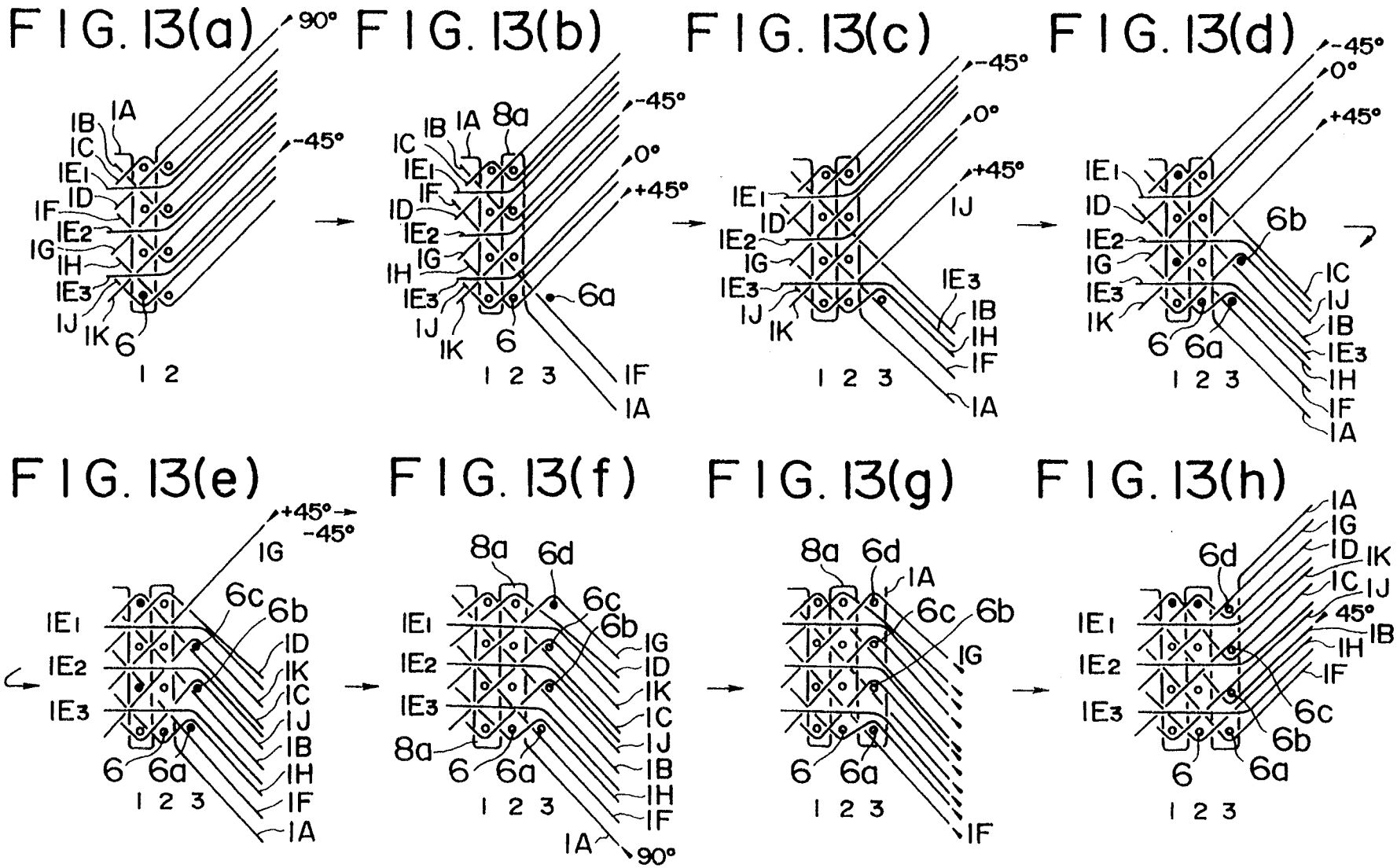
FIGS. 13(*a*)–13(*h*) are schematic views illustrating the sequence of operations of one embodiment of the weaving method of the present invention, as described in detail hereinafter.
Figure 13I:
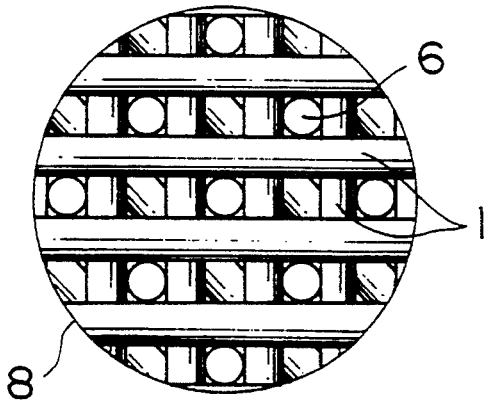

FIG. 13(*a*) shows the state in which the beating of second row has been completed just before the beating of third row starts. In this state, all healds for all warps are raised. FIG. 13(*b*) shows the state in which the heald for the warp 1A lowers to the lowermost end, the heald for the warp if also lowers, and the weft 6*a* is inserted into the shedding portion formed between the warps 1H and 1F.

In FIG. 13(*c*), the healds for the warps 1H, $1E_3$, and 1B lower, and a shed is formed between these warps and the warp 1J. FIG. 13(*d*) shows the state in which the weft 6*b* is inserted in the shed in FIG. 13(*c*), the healds for the warps 1J, $1E_2$, and 1C lower so that the weft 6*b* is put between and wound by the warps 1J and 1B on the upper side of the weft 6*a*, and a shedding portion is formed between the warps 1C and 1K.

FIG. 13(*e*) shows the state in which the weft 6*c* is inserted in the shedding portion between the warps 1C and 1K, the healds for the warps 1K, $1E_1$, and 1D lower, the weft 6*c* is put between and wound by the warps 1C and 1K on the upper side of the weft 6*b*, and a shedding portion is formed between the warps 1D and 1G. FIG. 13(*f*) shows the state in which the weft 6*d* is inserted in the shedding portion between the warps 1D and 1G, and the heald for the warp 1G lowers. In this state, the healds for all warps lower.

Figure 15:
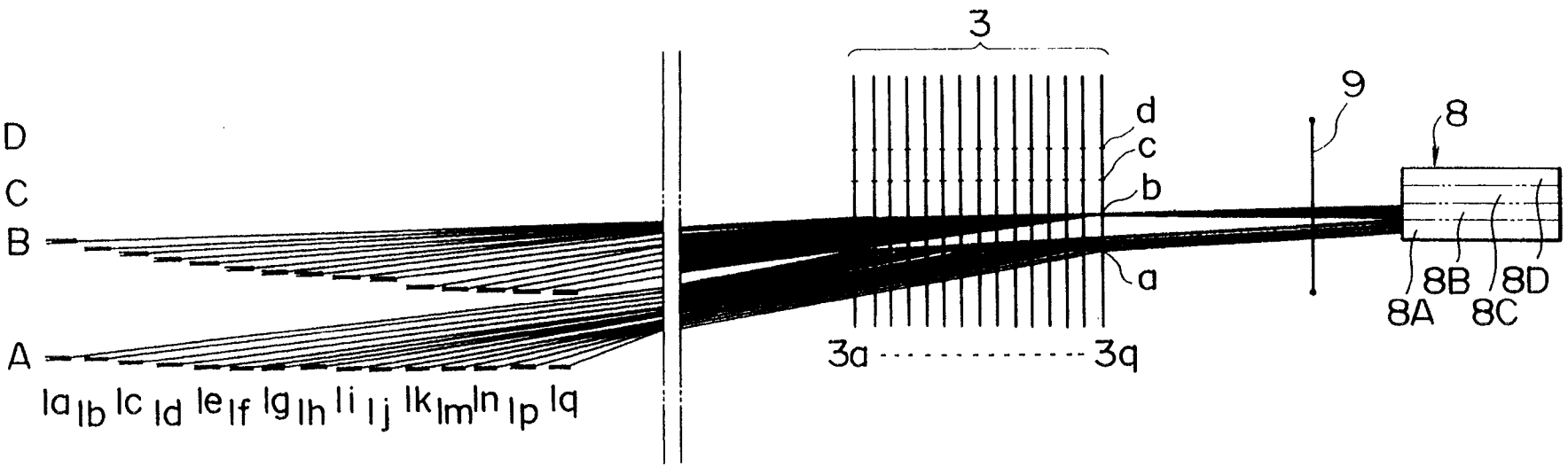
FIG. 15 is a schematic view illustrating a weaving method in the direction of the thickness of woven fabric (1 to 4 stage) in the present invention.

In the state shown in FIG. 13(*g*), the heald for the warp 1A rises from the lowermost end to the uppermost end, and the warp 1A wraps the wefts 6*a* to 6*d*. FIG. 13(*h*) shows the state in which the healds for all warps rise, and the third row is formed. Although the embodiment of FIG. 13 shows only one plane in the thickness direction of woven fabric 8, a woven fabric of a predetermined thickness is integrally manufactured in the direction of weft 6 at the same time. This state will be described with reference to FIG. 15. A, B, C, and D in FIG. 15 show respective warps 1*a* to 1*q* of one texture at the first stage 8A, the second stage 8B, the third stage 8C, and the forth stage 8D in the thickness direction of the woven fabric 8. FIG. 15 shows the state in which these warps pass the healds 3*a* to 3*q* to manufacture the woven fabric 8. In FIG. 15, a, b, c, d show the mail of the first through fourth stages, respectively. FIG. 13(*i*) is an enlarged cross-sectional view of a plane of the woven fabric 8.

Although not shown in the above description of operation, just before the formation of selvedge due to the upper end warp 1A in FIG. 13(*a*), the formation of selvedge due to the lower end warp 1A in FIG. 13(*b*), the formation of selvedge due to the warp 1D in FIG. 13(*c*), (*d*), and (*e*), the formation of selvedge of upper and lower portions due to warp 1G and 1A in FIG. 13(*f*), and the formation of selvedge of lower end due to the warp 1F in FIG. 13(*g*), the hook 11*a* of the selvedge holding mechanism 11 in FIG. 5 is engaged with the selvedge forming portion due to these warps, by which the selvedge 8*a* of the woven fabric 8 is automatically fixed by the hook or the like with ease.

The up-and-down movable rack 7 is a mechanism for moving the fabric 8 up and down by the servomotor 29 (see particularly FIGS. 10–13 (*h*)).

In FIG. 13(*b*), the warps 1A and 1F are moved downward slantwise to the right and other warps are moved upward slantwise to the right, so as to form an opening in order to insert the weft 6 by the shuttle 5. Also as shown in FIGS. 13(*c*), (*d*) and (*e*), the weft 6 is inserted by the shuttle 5 while the open portion of the warp is being gradually moved upwardly. However, the shuttle 5 makes reciprocating movements at a predetermined height in the direction at right angles to the surface of the fabric to be woven. Therefore, when the open portion completes its movement upwardly or downwardly, the shuttle will pass through the warp not yet opened so that it is impossible to weave the fabric as designed in the pattern.

Therefore, according to the present invention, the fabric 8 is caused to move by the up-and-down movable rack 7 (when the open portion is moved upwardly, then the up-and-down movable rack 7 is directed downwardly), so that the open portion is always coincident with the position of passage of the shuttle 5 whereby the weft 6 can be inserted without undergoing interference of the warp.

The above operation of the up-and-down movable rack 7 would be readily understood to one having ordinary skill in the art and the above description. Therefore, further details have not been shown.

With regard to the operation of the selvedge holding mechanism, the weave-end retaining mechanism 11 is intended to prevent crushing of the fabric in the direction of width due to tension of the fabric in the direction at right angles to the direction of length of slant fibers and the fabric 8. The weave-end retaining mechanism 11 is secured to the up-and-down movable rack 7 so that the mechanism cannot move sideways even when the fabric 8 is pulled out by the fabric take-out portion 10. This actuation is carried out before the weft most proximate to the endmost portion of the fabric 8 (for example, 6 or 6*a* in FIG. 13(*b*)) is inserted (or after insertion, until the next opening is made). At the point of time of such actuation, it is necessary to engage the roller 14 and hook 11*a* with a square hole (see FIG. 4) formed at the top end of the rail 12 (in the case of upper end of the fabric) or rail 13 (in the case of lower end of the fabric) and subsequently, it is necessary to set both ends of the bar 11*b* on the hook 11*a* after engaging the fiber constituting the weave-end (1H, 1F and 1A in FIG. 13(*b*)) by the bar 11*b*. The removing operation may be carried out manually.

Figure 16:
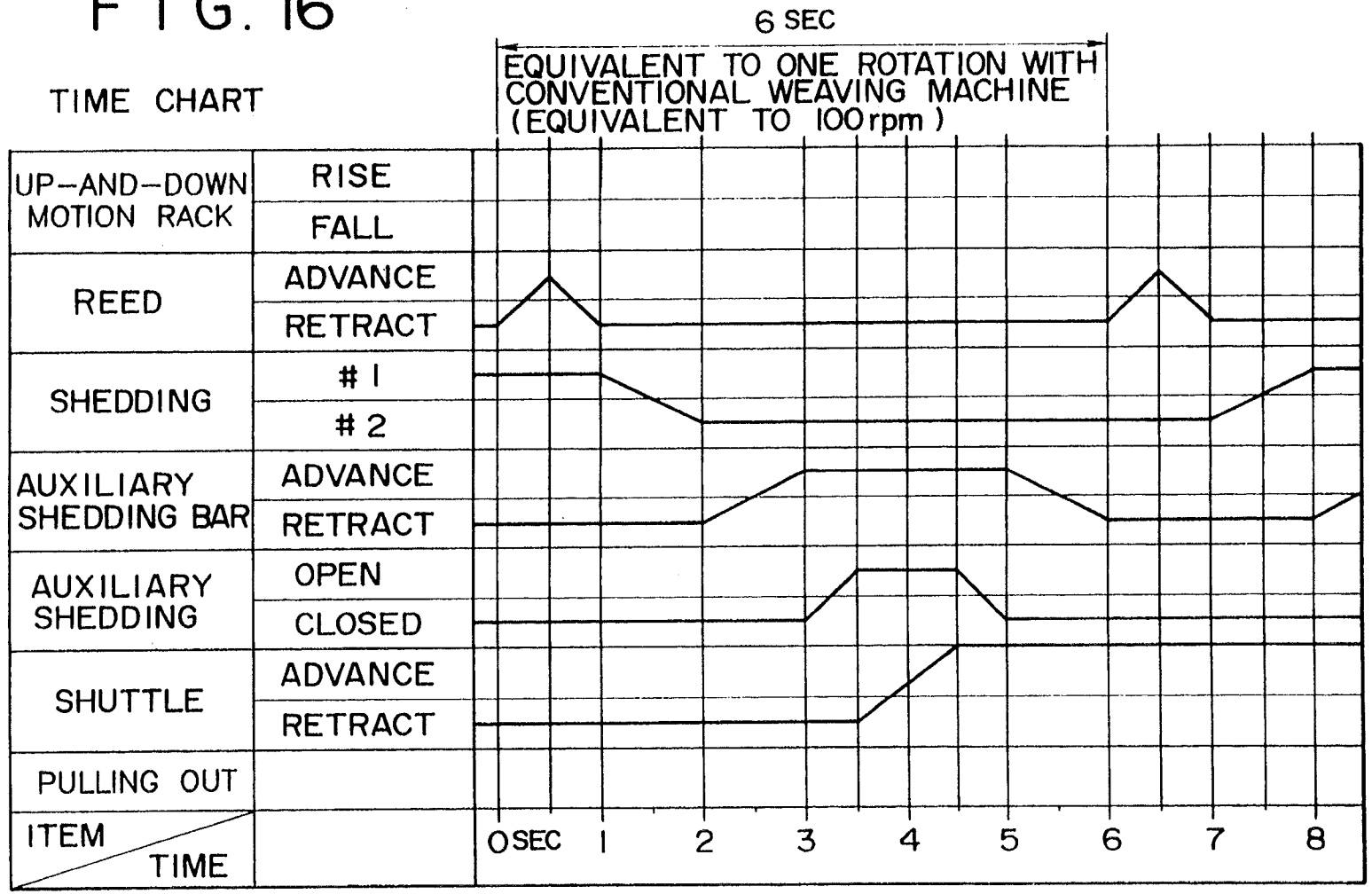
FIG. 16 is a timing chart for the weaving method of the present invention.
Figure 17:
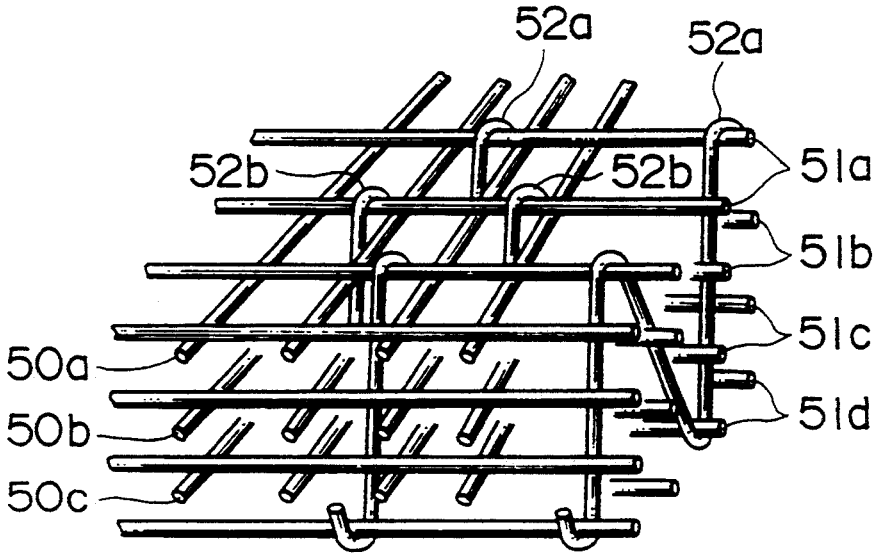
FIG. 17 (PRIOR ART)
FIG. 17 is a perspective view of one example of a conventional three-dimensional woven fabric.
Figure 18:
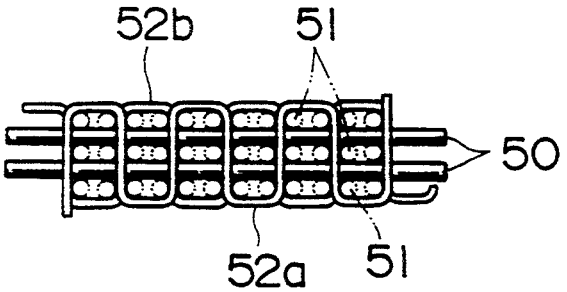
FIG. 18 (PRIOR ART)
FIG. 18 is a cross-sectional view of the woven fabric of FIG. 17.

Next, an example of time chart in accordance with the present invention will be described with reference to FIG. 16. A winding roller is raised or lowered by the up-and-down motion rack 7 driven by a servomotor in response to the shedding position; its operation is not particularly described.

For the operation of the reed, the reed advances from the retracted position for the time period from 0 to 1 second to perform beating and weaving of the first row. For the time period from 1 to 6 seconds, the reed is at the retracted position. For the time period from 6 to 7 seconds, the reed performs the beating of the second row. Afterward, the same operation is repeated.

The shedding of warp due to heald changes from #1 to #2 one second after the beating is completed. Afterward, the shedding remains in the condition of #2 until 7 seconds. When 7 seconds elapses, the shedding changes from #2 to #1, and afterward it remains in the condition of #1.

The auxiliary shedding bar is at the retracted position until 2 seconds. It advances for the time period from 2 to 3 seconds, remains at the advanced position for the time period from 3 to 5 seconds, retracts for the time period from 5 to 6 seconds, and remains at the retracted position afterward. The auxiliary shed, which moves in association with the auxiliary shedding bar, closes for the time period from 0 to 3 seconds, opens for the time period from 3 to 3.5 seconds, remains open until 4.5 seconds, closes by 5 seconds, and afterward remains closed.

The shuttle is at the retracted position until 3.5 seconds when beating, shedding of warp due to heald, and auxiliary shedding due to the auxiliary bar are performed. For the time period from 3.5 to 4.5 seconds, the shuttle advances to insert a weft into the shed of warp. This inserting condition continues to 8 seconds and afterward.

The basic motion of the shuttle 5 is the same as already explained in general in the aforesaid description of movable rack 7.

The drawings of FIGS. 13(*a*)–(*h*) at lower left and in FIG. 13(*i*), show the manner in which a woven fabric is produced by the invention, including the motion of the shuttle. (The texture of the fabric has nothing to do directly with the present invention.) The bobbin wound by the weft 6 is set on the shuttle 5, so that it entangles the weft due to reciprocation of the shuttle until the fabric is completed. Accordingly, the weft is shown integrally connected in the woven fabric.

Figure 12:
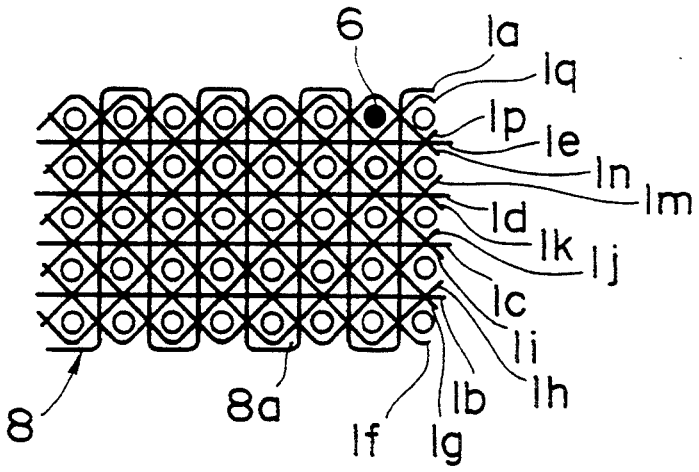
FIG. 12 is a cross-sectional view of a woven fabric manufactured by the method shown in FIGS. 10 and 11.

In FIGS. 10 through 12, the weaving method in which wefts are piled vertically at five stages has been described, while in FIGS. 13(*a*)–13(*h*), the weaving method in which wefts are piled vertically at four stages has been described. If the number of healds is increased, a vertically wide woven fabric can be manufactured. In this case, however, a sufficient shedding angle to pass the shuttle cannot sometimes be obtained. At this time, the auxiliary shedding device is used. After the auxiliary shedding device moves to between the warps after opening, it turns 90 degrees to forcibly open the warps, and provides a sufficient warp shedding angle to pass the shuttle. After the shuttle is passed, the auxiliary shedding device is returned to the original position to perform beating.

The above embodiment has shown only one example; the present invention is not limited to this range.

We claim:

1. A method of manufacturing multiaxial thick woven fabrics using a weaving machine having healds through which warps are passed, a shuttle reciprocating to insert wefts in a warp shedding portion formed by said healds, a reed, and a woven fabric removing device for removing woven fabric in a predetermined direction comprising:

providing a large number of healds in parallel in said predetermined direction of woven fabric removal;

forming a shedding position by passing a predetermined number of warps through said healds for forming a woven fabric having a desired width between sides thereof and a desired thickness and reciprocating said healds in the direction of said width of said woven fabric;

moving said shedding position sequentially from one of said sides to the other of said sides in said direction of width;

inserting a weft sequentially in said shedding position and shifting the position of said weft in said direction of width;

fixing said warps in position to set a width of a selvedge and form a first row having a texture determined by said width and thickness by engaging a selvedge formed by a warp at each side in said direction of width; and manufacturing a multiaxial thick woven fabric of a continuous length by sequentially performing shedding, weft insertion, and beating and comprising shifting said shedding position from the passage of travel of said shuttle, and moving said woven fabric removing device vertically corresponding with said passage of travel of said shuttle.

2. The method of manufacturing multiaxial thick woven fabrics as claimed in claim 1 and further comprising:

maintaining constant the width between selvedges formed by the warp at each of said sides in said direction of width of woven fabric to be manufactured for preventing shrinkage of said woven fabric in said direction of width due to tension of said warp.

* * * * *